US006485013B2

(12) United States Patent
Slippy et al.

(10) Patent No.: US 6,485,013 B2
(45) Date of Patent: Nov. 26, 2002

(54) METHOD AND APPARATUS FOR DETECTING MEDIA LEVEL IN A CASSETTE

(75) Inventors: Jamison B. Slippy, Middleton, ID (US); Steven R. Folkner, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/730,208

(22) Filed: Dec. 4, 2000

(65) Prior Publication Data

US 2002/0066313 A1 Jun. 6, 2002

(51) Int. Cl.[7] ..... B65H 7/02

(52) U.S. Cl. ..... 271/117; 73/291; 250/231.14; 347/234; 348/96; 271/98; 271/10.02; 271/110; 271/117

(58) Field of Search ..... 73/291; 250/231.14; 347/234; 348/96; 271/98, 10.02, 110, 117, 9

(56) References Cited

U.S. PATENT DOCUMENTS 4,431,985 A 2/1984 Mott
4,469,320 A * 9/1984 Wenthe, Jr. ..... 271/98
4,770,403 A * 9/1988 Katsumata et al. ..... 271/9
4,942,668 A 7/1990 Franklin
5,041,879 A * 8/1991 Akao et al. ..... 355/312
5,236,348 A * 8/1993 Fetherolf et al. ..... 116/303
5,243,860 A 9/1993 Habart
5,531,435 A * 7/1996 Momose ..... 271/258.03
5,534,691 A 7/1996 Holdaway et al.
5,565,912 A 10/1996 Easterly et al.
5,622,364 A * 4/1997 Dutton et al. ..... 271/117
5,629,672 A * 5/1997 Brown et al. ..... 340/540
5,853,171 A * 12/1998 Halpenny ..... 271/126
5,915,865 A 6/1999 Wade
6,049,348 A 4/2000 Spurr

* cited by examiner

*Primary Examiner*—Hezron Williams
*Assistant Examiner*—Andre' K. Jackson
(74) *Attorney, Agent, or Firm*—James R. McDaniel

(57) ABSTRACT

This invention relates to a method and apparatus for determining media level in a cassette. A single, fixed media level sensor is located adjacent to where the media is fed from the cassette. The bottom of the cassette is moved up until the top piece of media triggers the fixed sensor. The number of steps of the stepper motor (or the time an analog motor is on) indicates the distance the bottom of the cassette must be raised before the top of the media stack hits the sensor. The number of steps is used directly to determine the height of the stack of media and, therefore, the level of media in the cassette.

11 Claims, 1 Drawing Sheet

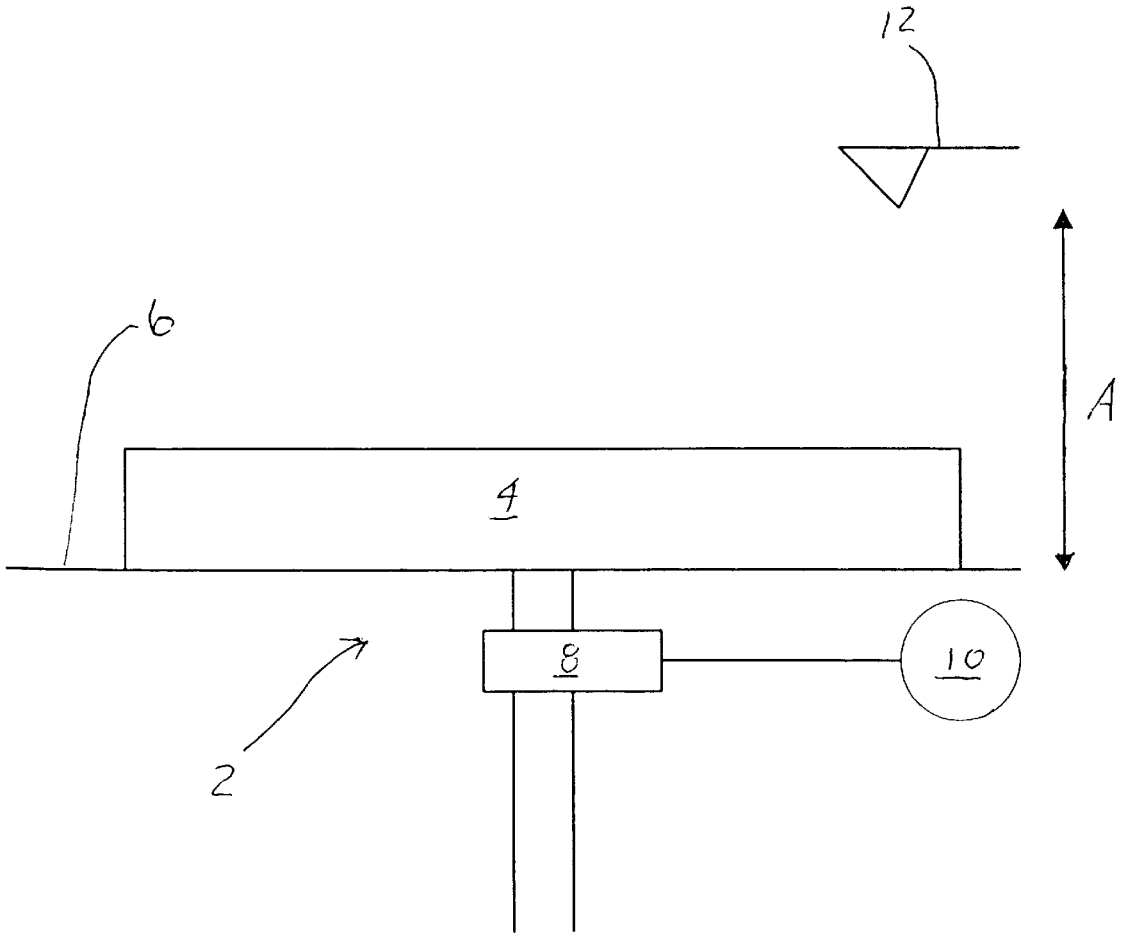
FIGURE

METHOD AND APPARATUS FOR DETECTING MEDIA LEVEL IN A CASSETTE

FIELD OF THE INVENTION

This invention relates to a method and apparatus for determining media level in a cassette. A single, fixed media level sensor is located adjacent to where the media is fed from the cassette. The bottom of the cassette is moved up until the top piece of media triggers the fixed sensor. The number of steps of the stepper motor (or the time an analog motor is on) indicates the distance the bottom of the cassette must be raised before the top of the media stack hits the sensor. The number of steps is used directly to determine the height of the stack of media and, therefore, the level of media in the cassette.

DESCRIPTION OF THE RELATED ART

It is known, in liquid level measurement devices, to employ a stepper motor. Exemplary of such prior art is U.S. Pat. No. 5,243,860 ('860) to P. Habart, entitled "Liquid Level Measurement." While the ('860) reference employs a stepper motor in which the stepper motor steps are counted in order to determine the level of the contained fluid, the moving sensor position is tracked by a marked belt that is moved by the stepper motor. The stepper motor counts are used to interpolate a level between the marks on the belt. Consequently, a more advantageous system would be presented, then, if the marked belt could be eliminated.

It is also known, in other types of measuring systems, to employ a stepper motor. Exemplary of such prior art is U.S. Pat. No. 4,431,985 ('985) to R. C. Mott, entitled "Stepper Motor System for Digitally Measuring Input Quantities." While the ('985) reference employs a stepper motor, the invention set forth in the ('985) reference is based on a relationship of forces. The input quantity results in a force and the stepper motor creates a second force. The relationship of the forces determines the value of the input. In particular, the stepper motor and the device are used for sensing something, which appears to be their only purpose. Conversely, a further advantageous system would be presented, then, if the stepper motor were used to lift and measure the motion of a stack of media.

In devices that have a bin to store sheet media, such as a laser printer paper tray, it is often desired to know the level of the media relative to "full." Many products currently use a system of photo-interrupt devices and "flags" which activate them. In printers, for example, there are commonly two photo-interrupts for each paper tray. Based on the location of the flag relative to the two interrupts, four different combinations of the flag locations can be generated, namely, off/off, on/off, on/on, and off/on. In turn, the combinations are logically decoded to indicate media level. However, the problems associated with this method of detection are that it does not allow the users to:

1. Accurately know the number of pages left. This is because the system gives a maximum of only four levels i.e., plus or minus ¼ or more of the media capacity for the tray.
2. Calculate and adjust for thicker/thinner media on-the-fly.
3. Furthermore, it is limited to spatial constraints (size, orientation, and location) of the photo-interrupt sensors and the added cost of these sensors.

Fundamentally, it is desirable for people using printers to know accurately and with high resolution the amount of paper remaining in each tray. The current art is to move an arm past several switches as the level of the paper changes. Resolution is limited by the number of switches. Clearly, more switches cost more money.

It is apparent from the above that there exists a need in the art for an apparatus and method for detecting media level in the cassette that is lightweight through simplicity of parts and uniqueness of structure, and which at least equals the media level detecting characteristics of the known apparatus and methods, but which at the same time employs a method of counting stepper motor steps. It is a purpose of this invention to fulfill this and other needs in the art in a manner more apparent to the skilled artisan once given the following disclosure.

SUMMARY OF THE INVENTION

Generally speaking, this invention fulfills these needs by providing an apparatus for detecting media level in a media cassette, comprising a media cassette containing an amount of a media, a media sensing means located at a predetermined distance above the media cassette, a media cassette moving means operatively connected to the media cassette, a drive means operatively connected to the media cassette moving means, and a drive monitoring means operatively connected to the drive means.

In certain preferred embodiments, the media cassette is a paper tray. Also, the media sensing means is a single, fixed sensor. Also, the media cassette moving means is a lift mechanism. Also, the drive means is a stepper motor. Finally, the drive monitoring means employs a counter to count the steps of the stepper motor.

In another further preferred embodiment, the use of the media sensing means, the drive means, and the drive monitoring means provides an accurate measurement of the height of the media located within the media cassette.

The preferred apparatus for detecting media level in a media cassette, according to this invention, offers the following advantages: accuracy in determining the number of pages in a media cassette; good stability; good durability; lightness in weight; improved resolution of media level; and excellent economy. In fact, in many of the preferred embodiments, these factors of accuracy, lightness in weight, resolution, and economy optimized to an extent that is considerably higher than heretofore achieved in prior, known apparatus for detecting media level in a media cassette.

The above and other features of the present invention, which will become more apparent as description proceeds, are best understood by considering the following detailed description in conjunction with the accompanying drawing FIGURE and in which:

BRIEF DESCRIPTION OF THE DRAWING

The FIGURE is a schematic illustration of an apparatus for detecting media level in a media cassette, according to one embodiment of the present invention.

DETAILED DESCRIPTION OF THE INVENTION

With reference to the FIGURE, there is illustrated one preferred embodiment for use of the concepts of this invention. In particular, apparatus 2 for detecting media level in a media cassette is illustrated. Apparatus 2 includes, in part, conventional media 4, conventional media cassette 6, drive motor 8, drive motor monitoring device 10, and sensor 12.

With respect to media 4, this, preferably, is any suitable sheet-like material that can be easily installed in media cassette 6. This can be, but is not limited to, paper, plastic, paperboard, metal, cloth or the like.

With respect to drive motor 8, this, preferably, is a stepper motor. However, an analog motor can also be used. In any event, it is to be understood that any motor of a known speed can be used to lift the media, but the motor must employ a timing loop in the processor or a hardware timer to determine when the motor stops and starts. Also, the motor must be large enough to provide enough torque to lift the cassette and the media. It is also to be understood that the motor may employ a conventional gear train reduction to gain a mechanical advantage and better resolution.

With respect to drive motor monitoring device 10, this, preferably, is the device that can count the steps of a stepper motor. If an analog motor is used, a timing device must be employed as the drive motor monitoring device. However, is to be understood that a variety of monitoring devices can be used as long as they are able to determine when the motor stops and starts, as described above and, thus be able to determine the distance moved by cassette 6.

Finally, with respect to sensor 12, this, preferably, is any suitable, single, fixed sensor located substantially above media cassette 6 at the level where the media is fed from the cassette. It is to be understood that sensor 12 must be able to sense when an object is in contact with it or, at least, in close proximity to it.

During the operation of apparatus 2, if the distance or range of motion between the bottom of empty cassette 6 and sensor 12 is not already known, empty cassette 6 is elevated along the direction of arrow A so that empty cassette 6 contacts sensor 12. In this manner, the full range of motion of cassette 6 can be determined. Next, an amount of media 4 is placed in cassette 6. Cassette 6 is moved up along the direction of arrow A by motor 8 until the top piece of media 4 contacts sensor 12. The movement of motor 8 indicates the distance the bottom of cassette 6 must be raised before the top of the stack of media 4 contacts sensor 12. This movement of motor 8 is used to directly determine the height of the stack of media 4 and, therefore, the level of media 4 in cassette 6.

If, for example, a stepper motor is used as motor 8, the motor will rotate many times for the small lifting of cassette 6 as it traverses along the direction of arrow A from a "bin full" to the "bin empty" position, if a gear reduction in motor 8 is also used. For each rotation of the stepping motor, there are many steps, typically one for every 15 degrees. Since each step is deliberately sent to motor 8 from a controller (not shown) conventionally located within motor 8, drive motor monitoring device 10 can be employed to count the steps of motor 8 and, therefore, provide a good resolution of the media level.

For example, assume that the gear reduction is 100:1 and that the stepper motor must rotate through 45 degrees of travel between bin full and bin empty conditions, a distance of 50 mm. Also, assume that the stepping motor has a 15 degree step pitch. It follows that the stepping motor will rotate 12.5 times or 300 steps. This results in six steps per mm of lift or 0.17 mm per step. A 20# piece of paper is, typically, 0.1 mm thick, so the resolution is ideally about two pages. However, is to be understood that apparatus 2 could estimate the number of pages of media 4 in cassette 6 even better with a better stepper motor, good tolerance stack up on the print device, and with more gear reduction.

While apparatus 2 is discussed with respect to measuring media 4 in cassette 6, it is to be understood that apparatus 2 could also be used to measure the height of part of any physical system by knowing the distance between the datum of that part and a known position where there is a sensor. By moving the sensor and datum closer to each other, the distance moved when the top of the part of the physical system triggers the sensor can be used to determine the height of the part.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for detecting media level in a media cassette, comprising the steps of:

determining a range of motion of an empty media cassette;

installing an amount of a media in said empty media cassette;

determining a height of said amount of said media in said media cassette, wherein said determining step is further comprised of the steps of; moving said empty media cassette, contacting said empty media cassette against a media sensing means located a predetermined distance above said empty media cassette, and calculating a range of motion of said empty media cassette; and detecting a level of said media in said media cassette.

2. The method, as in claim 1, wherein said step of determining a range of motion of said empty media cassette is further comprised of the steps of:

moving a media sensing means;

contacting said media sensing means against said empty media cassette located a predetermined distance below said media sensing means; and calculating a range of motion of said media sensing means.

3. The method, as in claim 1, wherein said step of determining a range of motion of said empty media cassette is further comprised of the step of:

measuring a distance between a bottom of said empty media cassette and a media sensing means.

4. The method, as in claim 1, wherein said step of calculating a range of motion of said empty media cassette is further comprised of the step of:

counting a number of steps moved by a stepper motor.

5. The method, as in claim 1, wherein said step of calculating a range of motion of said empty media cassette is further comprised of the step of:

timing a length of operation of an analog motor.

6. The method, as in claim 1, wherein said step of determining a height of said amount of said media in said media cassette is further comprised of the steps of:

moving said media cassette having said amount of media installed in said cassette;

contacting a top of said amount of media against said media sensing means; and calculating a range of motion of said media cassette having said amount of media installed in said cassette.

7. The method, as in claim 6, wherein said step of calculating a range of motion of said media cassette having said amount of media installed in said cassette is further comprised of the step of:

counting a number of steps moved by a stepper motor.

8. The method, as in claim 6, wherein said step of calculating a range of motion of said media cassette having said amount of media installed in said cassette is further comprised of the step of:

timing a length of operation of an analog motor.

9. The method, as in claim 1, wherein said step of detecting a level of:

said media in said cassette is further comprised of the steps of:

contacting said media sensing means with said media;

moving said media cassette so that a top of said amount of said media continues to contact said media sensing means;

calculating a range of motion of said media cassette as said media cassette is moved in order to remain in contact with said media sensing means.

10. The method, as in claim 9, wherein said step of calculating a range of motion of said media cassette is further comprised of the step of:

counting a number of steps moved by stepper motor.

11. The method, as in claim 9, wherein said step of calculating a range of motion of said media cassette is further comprised of the step of:

timing a length of operation of an analog motor.

* * * * *